US009344813B2

(12) United States Patent
Hasler et al.

(10) Patent No.: US 9,344,813 B2
(45) Date of Patent: May 17, 2016

(54) METHODS FOR OPERATING A HEARING DEVICE AS WELL AS HEARING DEVICES

(75) Inventors: Ivo Hasler, Winterthur (CH); Micha Knaus, Jona (CH)

(73) Assignee: SONOVA AG, Staefa (CH)

( * ) Notice: Subject to any disclaimer, the term of this patent is extended or adjusted under 35 U.S.C. 154(b) by 0 days.

(21) Appl. No.: 13/695,305

(22) PCT Filed: May 4, 2010

(86) PCT No.: PCT/EP2010/056032

§ 371 (c)(1),
(2), (4) Date: Oct. 30, 2012

(87) PCT Pub. No.: WO2010/086462

PCT Pub. Date: Aug. 5, 2010

(65) Prior Publication Data

US 2013/0064403 A1 Mar. 14, 2013

(51) Int. Cl.
*H04R 25/00* (2006.01)

(52) U.S. Cl.
CPC ..... *H04R 25/43* (2013.01); *H04R 25/554* (2013.01); *H04R 2460/07* (2013.01)

(58) Field of Classification Search
CPC ... H04R 25/505; H04R 25/70; H04R 2225/41
USPC ..... 381/312, 77–85; 700/94
See application file for complete search history.

(56) References Cited

U.S. PATENT DOCUMENTS

| | | | | |
|---|---|---|---|---|
| 5,333,153 | A * | 7/1994 | Brown et al. | 375/351 |
| 5,870,484 | A * | 2/1999 | Greenberger | 381/300 |
| 6,694,034 | B2 * | 2/2004 | Julstrom et al. | 381/315 |
| 7,167,567 | B1 * | 1/2007 | Sibbald et al. | 381/17 |
| 7,317,805 | B2 * | 1/2008 | Seligmann | 381/315 |
| 8,553,897 | B2 * | 10/2013 | Anderson | 381/60 |
| 2003/0044033 | A1 * | 3/2003 | Julstrom et al. | 381/315 |

(Continued)

FOREIGN PATENT DOCUMENTS

| | | |
|---|---|---|
| EP | 1296537 A2 | 3/2003 |
| EP | 1879426 A2 | 1/2008 |

(Continued)

OTHER PUBLICATIONS

International Search Report for PCT/EP2010/056032 dated Dec. 28, 2010.

(Continued)

*Primary Examiner* — Matthew Eason
*Assistant Examiner* — Sean H Nguyen
(74) *Attorney, Agent, or Firm* — Pearne & Gordon LLP

(57) ABSTRACT

Method for operating a hearing device (1) that is worn by a hearing device user (2), the method comprising the steps of receiving a transmission signal (4) comprising an audio signal (4) of a sound sources (S), determining a distance (d) between the sound source (S) and the hearing device (1), and generating an output signal supplied to an output transducer (8) of the hearing device (1) by at least taking into account the audio signal (4) of the transmission signal (3) and the distance (d). Further embodiments are directed to determining an angle (α) defined by a sagittal plane (5) of the hearing device user (2) and a line drawn between the hearing device (1) and the sound source (S). The angle (α) is additionally used to generate the output signal supplied to the output transducer (8) of the hearing device (1).

26 Claims, 3 Drawing Sheets

(56) References Cited

U.S. PATENT DOCUMENTS

| | | | | |
|---|---|---|---|---|
| 2003/0210800 | A1* | 11/2003 | Yamada et al. | 381/310 |
| 2005/0244012 | A1* | 11/2005 | Asada | 381/56 |
| 2005/0265559 | A1* | 12/2005 | Asada | 381/18 |
| 2007/0110268 | A1* | 5/2007 | Konagai et al. | 381/335 |
| 2008/0226107 | A1* | 9/2008 | Boguslavskij et al. | 381/315 |
| 2009/0097668 | A1* | 4/2009 | Kim et al. | 381/71.1 |
| 2009/0141915 | A1* | 6/2009 | Ko et al. | 381/182 |
| 2010/0008515 | A1* | 1/2010 | Fulton et al. | 381/92 |
| 2010/0034406 | A1* | 2/2010 | Fischer et al. | 381/317 |
| 2010/0195836 | A1* | 8/2010 | Platz | 381/26 |
| 2010/0278366 | A1* | 11/2010 | Biundo Lotito et al. | 381/315 |
| 2011/0007916 | A1* | 1/2011 | Chapero-Rueda et al. | 381/315 |
| 2012/0179835 | A1* | 7/2012 | Morris et al. | 709/238 |

FOREIGN PATENT DOCUMENTS

| | | | | |
|---|---|---|---|---|
| WO | 2008/006772 | A2 | 1/2008 | |
| WO | WO 2008043731 | A1 * | 4/2008 | H04R 25/00 |
| WO | 2008/071807 | A2 | 6/2008 | |
| WO | WO 2008071807 | A2 * | 6/2008 | H04R 25/00 |
| WO | 2009/049645 | A1 | 4/2009 | |
| WO | WO 2009049646 | A1 * | 4/2009 | H04R 25/00 |

OTHER PUBLICATIONS

Written Opinion for PCT/EP2010/056032 dated Dec. 28, 2010.

* cited by examiner

METHODS FOR OPERATING A HEARING DEVICE AS WELL AS HEARING DEVICES

FIELD OF THE INVENTION

The present invention is related to methods for operating a hearing device that is worn by a hearing device user as well as to hearing devices.

BACKGROUND OF THE INVENTION

Numerous types of hearing devices are known and have been developed to assist individuals with hearing loss. Examples of hearing device types currently available include behind the ear (BTE), in the ear (ITE), in the canal (ITC) and completely in the canal (CIC) hearing devices. In many situations, however, hearing impaired individuals may require a hearing solution beyond that which can be provided by such a hearing device alone. For example, hearing impaired individuals often have great difficulty to follow a normal conversations in noisy environments, encountered at parties, meetings, sporting events or the like, involving a high level of background noise. In addition, hearing impaired individuals often also have difficulties listening to audio sources located at a distance from the individual, or to several audio sources located at various distances from the individual and at various positions relative to the individual.

A known hearing aid system comprising a secondary source for audio has been described in U.S. Pat. No. 6,694,034 B2. The known hearing aid system comprises a directional microphone worn or otherwise supported by a person speaking or by the hearing aid user, as well as detection and switch circuitry to select which of the primary and secondary audio sources should be directed to the hearing aid circuitry. In operation, the detection and switch circuitry receives a signal transmission (preferably wireless) from the secondary audio source and determines whether the signal received is desirable. If the signal transmission is desirable, the circuitry selects that signal for coupling with the hearing aid circuitry. If the transmission signal is not desirable, the circuitry selects the signals from the primary audio source for coupling with the hearing aid circuitry. The criterion for selecting the signal of the secondary audio source is based on the signal strength. If the incoming signal of the secondary audio source is greater than a predetermined threshold, the signal of the secondary audio source is selected for transmission into the ear canal of the hearing aid wearer.

Similar techniques as the one described above are disclosed by U.S. Pat. No. 7,317,805 B2 and EP-1 296 537 A2.

The known teachings are only directed to detecting sound sources or they try to qualify sound sources. Natural behavior of a hearing device user is not taken into account.

Many objects, aspects and variations of the present invention will become apparent to one of skill in the art upon review of the prior art and in light of the teachings herein.

SUMMARY OF THE INVENTION

These and other problems experienced by hearing device users are addressed by the methods and the hearing devices of the present invention.

It is pointed out that the term "hearing device" must not only be understood as a device that is used to improve the hearing of hearing impaired patients, but also as a communication device to improve communication between individuals. In addition, the term "hearing device" comprise hearing device types currently available, as for example behind the ear (BTE), in the ear (ITE), in the canal (ITC) and completely in the canal (CIC) hearing devices. Furthermore, hearing devices may also be fully or partially implantable.

First, the present invention is directed to a method for operating a hearing device that is worn by a hearing device user, the method comprising the steps of:

- receiving a transmission signal comprising an audio signal of a sound sources,
- determining a distance between the sound source and the hearing device, and
- generating an output signal supplied to an output transducer of the hearing device by at least taking into account the audio signal of the transmission signal and the distance.

An embodiment of the present invention further comprises the steps of:

- determining an angle defined by a sagittal plane of the hearing device user and a line drawn between the hearing device and the sound source, and
- generating the output signal supplied to an output transducer of the hearing device by further taking into account the angle.

Second, the present invention is directed to a method for operating a hearing device that is worn by a hearing device user, the method comprising the steps of:

- receiving a transmission signal comprising an audio signal of a sound sources,
- determining an angle defined by a sagittal plane of the hearing device user and a line drawn between the hearing device and the sound source, and
- generating an output signal supplied to an output transducer of the hearing device by at least taking into account the audio signal of the transmission signal and the angle.

Embodiments of the present invention further comprise the steps of:

- determining a distance between the sound source and the hearing device,
- generating the output signal supplied to an output transducer of the hearing device by further taking into account the distance.

In further embodiments of the present invention, the step of generating the output signal supplied to the output transducer of the hearing device further takes into account a radiation angle that is defined by an angle between a radiation direction of sound of the sound source and a line drawn between the hearing device and the sound source.

In still further embodiments of the present invention, the sound source is a virtual sound source, of which a transmission signal comprising the audio signal is available only.

Embodiments of the present invention further comprise the steps of:

- receiving an acoustic signal by an input transducer of the hearing device, the acoustic signal comprising the audio signal of the sound source,
- generating the output signal supplied to the output transducer of the hearing device by combining the audio signal of the transmission signal and the acoustic signal of the input transducer according to a combination ratio that is determined as a function of at least one of the distance, the angle and the radiation angle.

Embodiments of the present invention further comprise the steps of:

- receiving an acoustic signal by an input transducer of the hearing device, the acoustic signal comprising the audio signal of the sound source, generating the output signal supplied to the output transducer of the hearing device by reducing, according to a reduction rate, signal components of the audio signal of the sound source contained in the acoustic signal of the input transducer by using the audio signal of the transmission signal, the reduction rate being determined as a function of at least one of the distance, the angle and the radiation angle.

In still further embodiments of the present invention, the transmission signal is wirelessly transmitted to the hearing device.

Further embodiments of the present invention comprise the step of adjusting the distance as a function of obstacles between the hearing device and the sound source.

In still further embodiments of the present invention, the step of receiving the transmission signal comprising the audio signal of the sound source is performed in the hearing device.

Third, the present invention is directed to a hearing device comprising:

an input transducer, an output transducer, a processing unit operatively connected to the input transducer as well as to the output transducer, an interface unit for receiving a transmission signal comprising an audio signal of a sound source, the interface unit being operatively connected to the processing unit, means for determining a distance to the sound source, means for comparing the distance to a predetermined distance, and means for generating an output signal supplied to the output transducer of the hearing device by at least taking into account the audio signal of the transmission signal and the distance.

An embodiment of the inventive hearing device further comprises:

means for determining an angle defined by a sagittal plane of a hearing device user and a line pointing to the sound source, and means for generating the output signal supplied to the output transducer of the hearing device by further taking into account the angle.

Fourth, the present invention is directed to a hearing device comprising:

an input transducer, an output transducer, a processing unit operatively connected to the input transducer as well as to the output transducer, an interface unit for receiving a transmission signal comprising an audio signal of a sound source, the interface unit being operatively connected to the processing unit, means for determining an angle defined by a sagittal plane of a hearing device user and a line pointing to the sound source, and means for generating an output signal supplied to the output transducer by at least taking into account the audio signal of the transmission signal and the angle.

An embodiment of the inventive hearing device according to the fourth aspect further comprises:

means for determining a distance to the sound source, means for generating the output signal supplied to the output transducer by further taking into account the distance.

In further embodiments of the present invention, the means for generating the output signal supplied to the output transducer of the hearing device further takes into account a radiation angle that is defined by an angle between a radiation direction of sound of the sound source and a line drawn between the hearing device and the sound source.

In still further embodiments of the present invention, the sound source is a virtual sound source, of which a transmission signal comprising the audio signal is available only.

Embodiments of hearing device according to the present invention further comprise:

means for receiving an acoustic signal by an input transducer of the hearing device, the acoustic signal comprising the audio signal of the sound source, generating the output signal supplied to the output transducer of the hearing device by combining the audio signal of the transmission signal and the acoustic signal of the input transducer according to a combination ratio that is determined as a function of at least one of the distance, the angle and the radiation angle.

Embodiments of the hearing device according to the present invention further comprise:

means for receiving an acoustic signal by an input transducer of the hearing device, the acoustic signal comprising the audio signal of the sound source, generating the output signal supplied to the output transducer of the hearing device by reducing, according to a reduction rate, signal components of the audio signal of the sound source contained in the acoustic signal of the input transducer by using the audio signal of the transmission signal, the reduction rate being determined as a function of at least one of the distance, the angle and the radiation angle.

In still further embodiments of the hearing device according to the present invention, the transmission signal is wirelessly transmittable.

Further embodiments of the present invention comprise means for adjusting the distance as a function of obstacles lying in front of the sound source.

It is expressly pointed out that any combination of the above-mentioned embodiments, or combinations of combinations, is subject to a further combination. Only those combinations are excluded that would result in a contradiction.

DETAILED DESCRIPTION OF THE INVENTION

Figure 1:
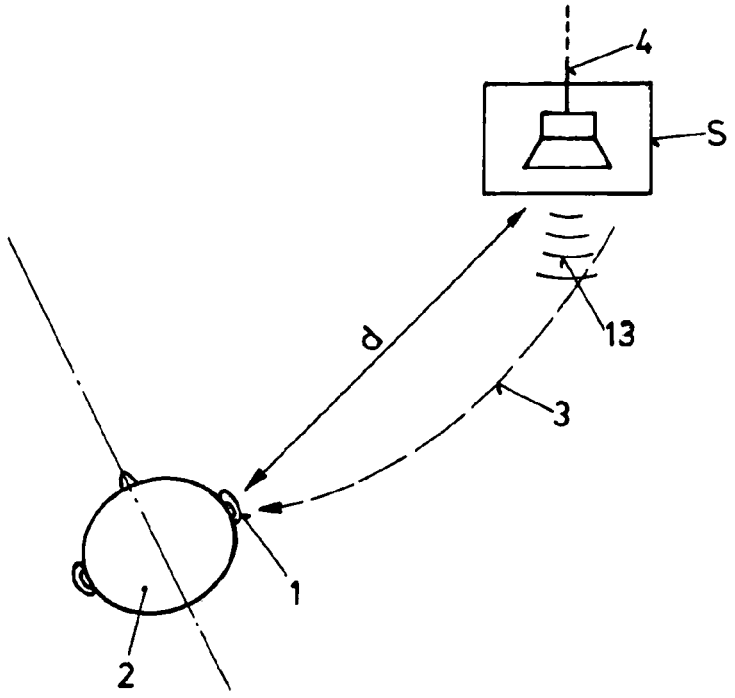
FIG. 1 schematically shows an arrangement comprising a hearing device user with inserted hearing devices and a sound source for illustration of a first embodiment of the present invention, FIG. 2 schematically shows an arrangement comprising the hearing device user with inserted hearing devices and the sound source for illustration of a second embodiment of the present invention, FIG. 3 schematically shows an arrangement comprising the hearing device user with inserted hearing devices and the sound source for illustration of a third embodiment of the present invention, FIG. 4 schematically shows an arrangement comprising the hearing device user with inserted hearing devices and the sound source for illustration of a fourth embodiment of the present invention.

FIG. 1 shows a top view of a hearing device user 2 wearing a hearing device 1 in or at one of his ears. Although the present invention is explained in connection with a monaural hearing device, the present invention can also very well be used in connection with a binaural hearing device. In fact, and as a result of the above-mentioned definition of the term "hearing device", the present invention can also very well be used in connection with any type of communication device.

Furthermore, FIG. 1 shows a sound source S that is located at a distance d from the hearing device 1 or the hearing device user 2, respectively. The sound source S may be of any type, in particular it may be one of the following devices:

TV device;
screen, e.g. in a movie theater;
teller at a bank, post office, railway station, or the like;
lectern;
pulpit microphone;
remote microphone;
hi-fi system.

The sound source S is able to broadcast an audio signal 4 as an acoustic signal 13. At the same time, the audio signal 4 is comprised in a transmission signal 3 that is transmitted by a transmitter unit comprised in the audio source S. The transmitter unit may also be attached to the audio source S. The transmission signal 3 may be distributed by wire or wirelessly. In particular, the transmission signal 3 is distributed in one or more than one of the following manners:

cable, e.g. Ethernet cable;
infrared;
Bluetooth standard;
Wireless Local Area Network (WLAN);
Global System Mobile (GSM), or any other standard, e.g. UMTS.

Since the hearing device 1 comprises an input transducer (not shown in FIG. 1), e.g. a microphone, the acoustic audio signal 13 of the sound source S is picked up by the input transducer and processed by the hearing device 1. In addition, the hearing device 1 comprises means for searching for a transmission signal 3 of the sound source S, the transmission signal 3 being an electric or electro-magnetic signal comprising the audio signal 4. It is pointed out that the audio signal 4 can be modulated in any form (e.g. frequency or amplitude modulated) or placed in any protocol in order to easily transmit the audio signal 4 to the hearing device 1. In fact, the audio signal 4 is available in two forms in the hearing device 1, namely as a clear and undisturbed audio signal directly from the audio source S via the transmission signal 3, and as an output signal of the input transducer of the hearing device 1, the output signal comprising the acoustic audio signal 13 as well as any possible surrounding sound and/or noise.

In the first embodiment of the present invention, a distance d between the sound source S and the hearing device 1 is determined. This can be achieved in one of the following manners:

the position of the hearing device is fix and known;
GPS—(Global Positioning System) or similar positioning method is used;
position is transmitted via a protocol; for example, the position is incorporated into the transmission signal;
calculation of the relative position via differentiation;
by determination of moving direction and with a acceleration sensor;
with the aid of acoustic localization of the audio source S in the hearing device 1 by comparing the audio signal obtained by the input transducer and the audio signal incorporated into the transmission signal 3;
distance measurement by signal propagation delay.

The distance d is compared to a predetermined distance which is set beforehand. The predetermined distance is a threshold below which the audio signal of the transmission signal 3 is at least partly supplied to an output transducer (not shown in FIG. 1) of the hearing device 1. The predetermined distance is set to a value in dependence on an actual situation. For example, if the audio source S is a TV set, the predetermined distance must not be overly larger than a distance between the TV set and the sofa the hearing device user usually sits on when watching TV.

With regard to the extent of supplying the audio signal 4 of the transmission signal 3 to the output transducer, i.e. the hearer or loudspeaker of the hearing device 1, it is pointed out that it can mean to fully supply the audio signal 4 of the transmission signal 3 to the output transducer without containing any part of the output signal of the input transducer of the hearing device 1. In other words, the hearing device user 2 only hears the audio signal 4 coming directly from the sound source S via the transmission signal 3. There is absolutely no disturbing sound of the surrounding.

While a full attenuation of the output signal of the input transducer results in a clear and undisturbed signal for the output transducer, and therewith in a high comfort level for the hearing device user 2, communication with other individuals becomes more difficult. In further embodiments, it is therefore suggested that the output signal of the input transducer of the hearing device 1 is not fully attenuated. Instead, the output signal of the input transducer is only attenuated to an extent that other acoustic sources can still be heard. Therewith, the hearing device user 2 is not completely isolated and can still communicate with other individuals. Most importantly, the hearing device user 2 can hear possible alarm signals, like a fire alarm.

A supply of the audio signal 4 of the transmission signal 3 to the hearing device user 2 does not make sense if the distance d between the hearing device user 2 and the sound source S is too big. For example, a TV set in a large room might only become important if the hearing device user 2 is within a range in that he can clearly see what is shown on the screen of the TV set. This can be taken into account when determining the predetermined distance.

Figure 2:
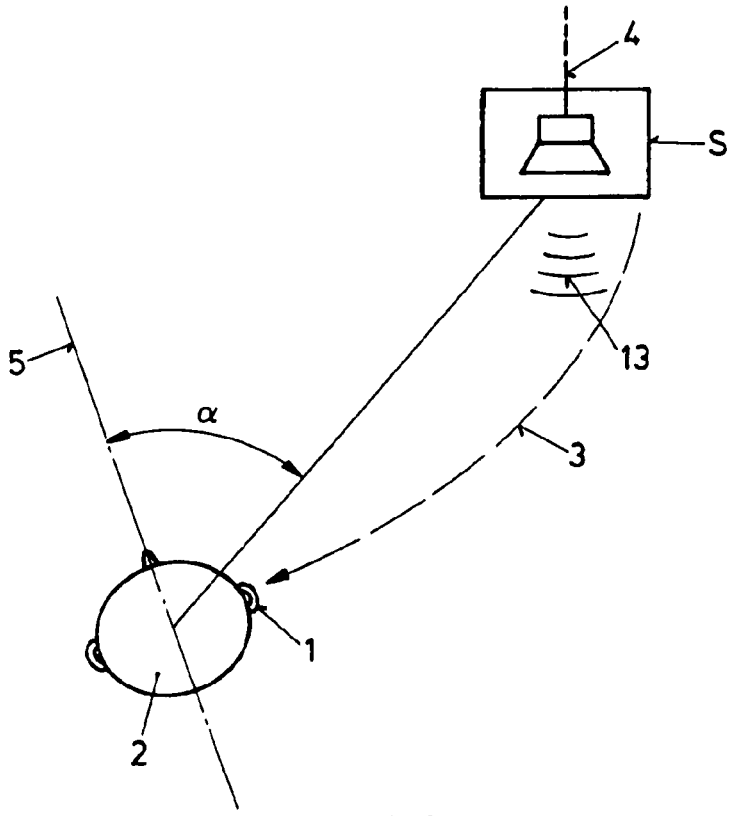

FIG. 2 shows a further embodiment of the present invention. The same situation is depicted as in FIG. 1, namely a hearing device user 2 wearing a hearing device 1 as well as a sound source S. It is pointed out that the same reference sign as in FIG. 1 are used in FIG. 2. Instead of determining a distance d as it has been done in connection with the situation depicted in FIG. 1, an angle $\alpha$ is determined that is defined by a sagittal plane 5 of the hearing device user 2 and a line drawn between the hearing device 1 and the sound source S. Once the angle $\alpha$ is obtained, it is used to determine how much of the audio signal 4 of the transmission signal 3 is supplied to the output transducer of the hearing device 1. The extent of supplying the audio signal 4 of the transmission signal 3 to the output transducer is governed by a function of the angle $\alpha$. An example for such a function is the trigonometric function cosine: If the hearing device user 2 is facing the sound source S, for which $\alpha$ is equal to 0°, the audio signal 4 of the transmission signal 3 has a large influence on the input signal of the output transducer (not shown in FIG. 2). On the other hand, if the hearing device user 2 is turning his head to the side, for example towards another person, the influence of the audio signal 4 of the transmission signal 3 on the output transducer of the hearing device 1 is reduced or eventually eliminated. Therewith, the possibility is opened up to allow the hearing device user 2 to communicate with other individuals without being too much disturbed by the audio signal 4 of the transmission signal 3.

For example, the angle α can be determined in one of the following ways:

the orientation of the hearing device is known;

electronic compass is integrated into the hearing device while the sound source S is known;

GPS—(Global Positioning System) or a similar orientation measurement method is used;

orientation is transmitted via a protocol;

calculation of the relative orientation via differentiation;

by determination of moving direction and with a acceleration sensor;

with the aid of acoustic localization of the sound source S in the hearing device 1 by comparing the audio signal 4 obtained by the input transducer and the audio signal incorporated into the transmission signal 3;

radar like, e.g. transponder.

Figure 3:
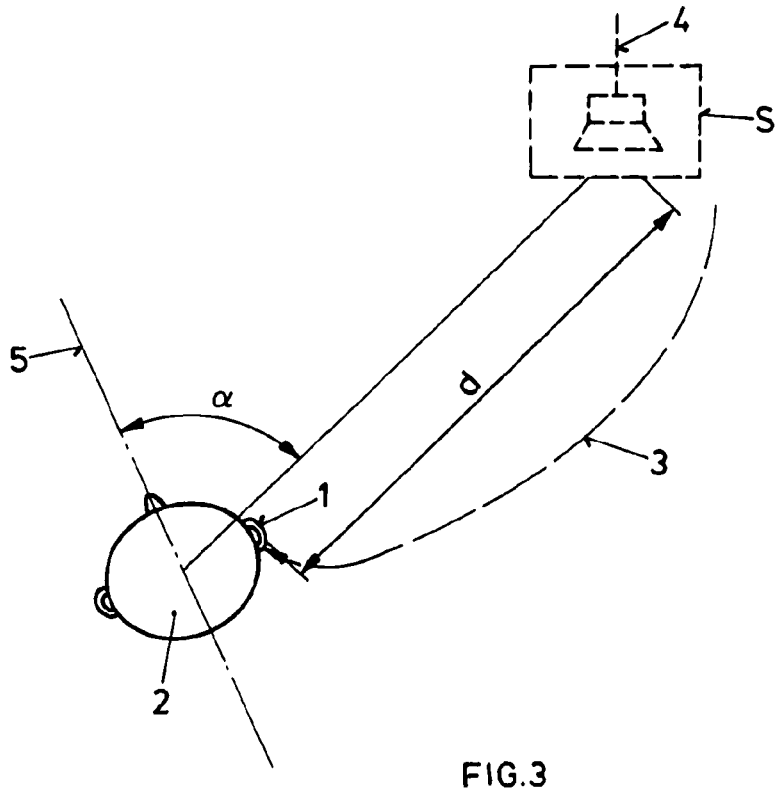

FIG. 3 shows a further embodiment of the present invention.

Again, a similar situation is depicted as in FIGS. 1 and 2. In fact, the embodiment of FIG. 3 represents a combination of the embodiments depicted in FIGS. 1 and 2 in that the distance d between the sound source S and the hearing device 1 as well as the angle α defined by the sagittal plane 5 of the hearing device user 2 and the line drawn between the hearing device 1 and the sound source S are taken into account while determining the influence of the audio signal 4 of the transmission signal 3 on the output transducer of the hearing device 1. To what extent the distance d and the angle α have effect on the input signal of the output transducer in the hearing device 1 can be determined in the same or similar manners as have been explained in connection with the embodiments of FIGS. 1 and 2.

A still further embodiment of the present invention is pointed out while referring to FIG. 3: the sound source S is a so called virtual sound source in that it does not physically exist but only virtually. The location—and therewith the distance d and the angle α, respectively—is defined virtually and it is assumed that the transmission signal 3 is transmitted from this location. In fact, the transmission signal 3 comprising the audio signal 4 can be transmitted from any location. This is why the sound source S is represented in dashed lines and why there is not shown the acoustic audio signal 13 as in FIGS. 1 and 2. Apart from this virtual arrangement, this embodiment has the same characteristics or combination of characteristics as the embodiments explained in connection with FIGS. 1 and 2, with the exception that the sound source S does not physically exist.

Figure 4:
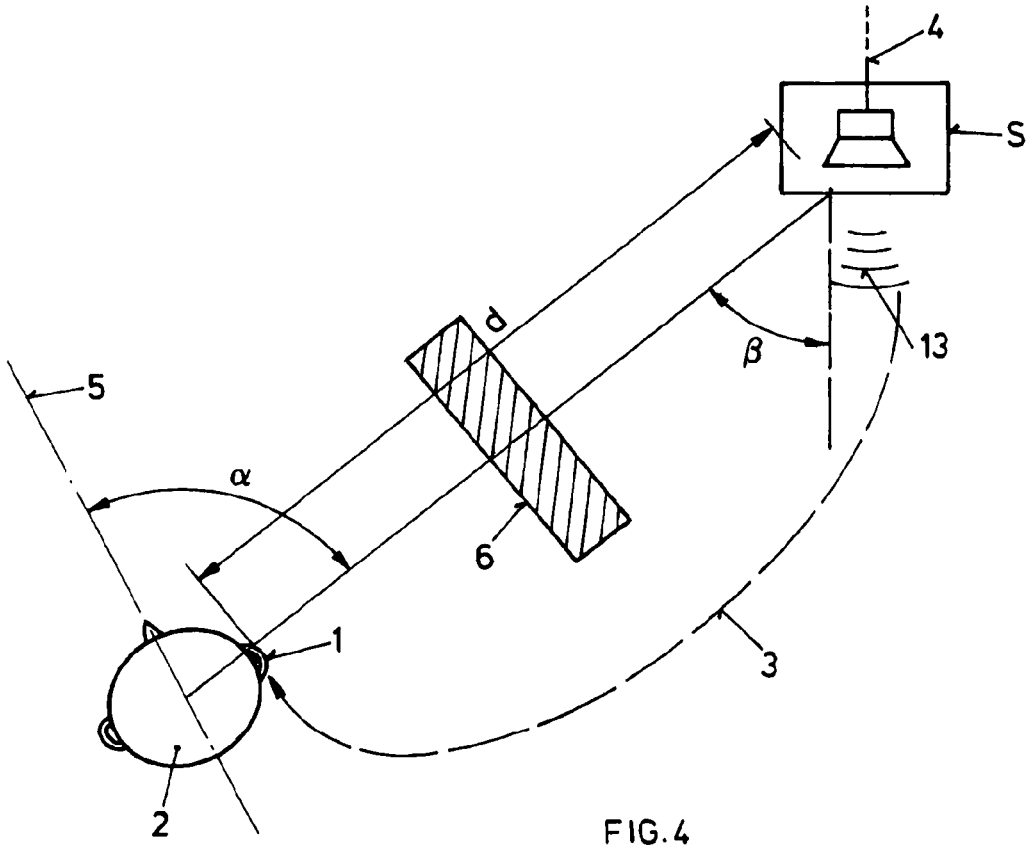

In FIG. 4, yet a further embodiment of the present invention is depicted. As in FIGS. 1 to 3, the hearing device user 2 wearing a hearing device 1 as well as the sound source S is represented. Accordingly, the explanations made in connection with the embodiments depicted in FIGS. 1 to 3 are also valid. FIG. 4 additionally shows an obstacle 6 between the hearing device user 2 and the sound source S, be it physically present or be it virtually only, and a radiation angle β that is defined between a radiation direction of the acoustic audio signal 13 of the sound source S and a line drawn between the hearing device 1 and the sound source S. The radiation angle β is used, in one embodiment, to damp the audio signal 4 of the transmission signal 3, i.e. the influence on the input signal of the output transducer of the hearing device 1 is dependent on the radiation angle β, in particular the influence on the input signal of the output transducer of the hearing device 1 is a function of the radiation angle β. This is very useful in a situation, for example, where the hearing device user 2 positions himself behind the sound source S. In particular for a TV set as sound source S, a clear damping of the audio signal 4 of the transmission signal 3 will be welcomed by the hearing device user 2, because one can assume that the hearing device user 2 is not interested in the audio signal of the TV set without being able to see the image on the screen of the TV set.

Similar situations are obtained if an obstacle 6 between the hearing device user 2 and the sound source S is present. In dependence on the size of the obstacle 6, the audio signal 4 transmitted by the transmission signal 3 is reduced before it is fed to the input of the output transducer of the hearing device 1. This can also be interpreted by virtually increasing the actual distance d to a larger virtual distance d', the virtual distance d' becoming effective for any computation involving the distance d, in particular the computations explained in connection with the embodiments depicted in FIGS. 1 to 3.

In a further embodiment of the present invention, the output signal—that is supplied to the output transducer 8 (FIG. 5) of the hearing device 1—is generated by combining the audio signal 4 of the transmission signal 3 and the acoustic signal of the input transducer 7. The combination or mixing of the two signals is done according to a combination ratio that is determined as a function of at least one of the following parameters:

the distance d;

the angle α;

the radiation angle β.

As long as the hearing device user sits in front of the sound source S, while having turned his head towards the sound source S, the acoustic signal of the input transducer 7 is attenuated to a large extent. At the same time, most of the audio signal 4 of the transmission signal 3 is fed towards the output transducer 8 of the hearing device 1 in order that the hearing device user may very well hear what is broadcasted by the sound source S. As soon as the hearing device user turns his head away from the sound source S, thereby increasing the angle α, the combination ratio changes in that more signal of the input transducer 7 can be perceived allowing the hearing device user to listen to the surrounding. To improve the ability to listen to surroundings signals, the audio signal 4 of the transmission signal 3 is reduced at the same time (according to the combination ratio) in order that the hearing device user is not disturbed too much. Of course, the hearing device user may still hear the acoustic audio signal (as long as the sound source S is not a virtual sound source as in some embodiments). This embodiment has the advantage that the hearing device user may still hear when someone starts a communication.

In a still further embodiment of the present invention, the output signal—that is supplied to the output transducer 8 (FIG. 5) of the hearing device 1—is generated by reducing, according to a reduction rate, signal components of the audio signal 4 of the sound source S contained in the acoustic signal of the input transducer 7 by using the audio signal 4 of the transmission signal 3. The reduction rate is determined as a function of at least one of the following parameters:

the distance d;

the angle α;

the radiation angle β.

The reduction of the audio signal in the acoustic surrounding is obtained, for example, by known estimation algorithms that are used to estimate components of the audio signal that is present in the acoustic surrounding. The estimation is performed taking into account knowledge of the undisturbed audio signal received via the transmission signal.

Figure 5:
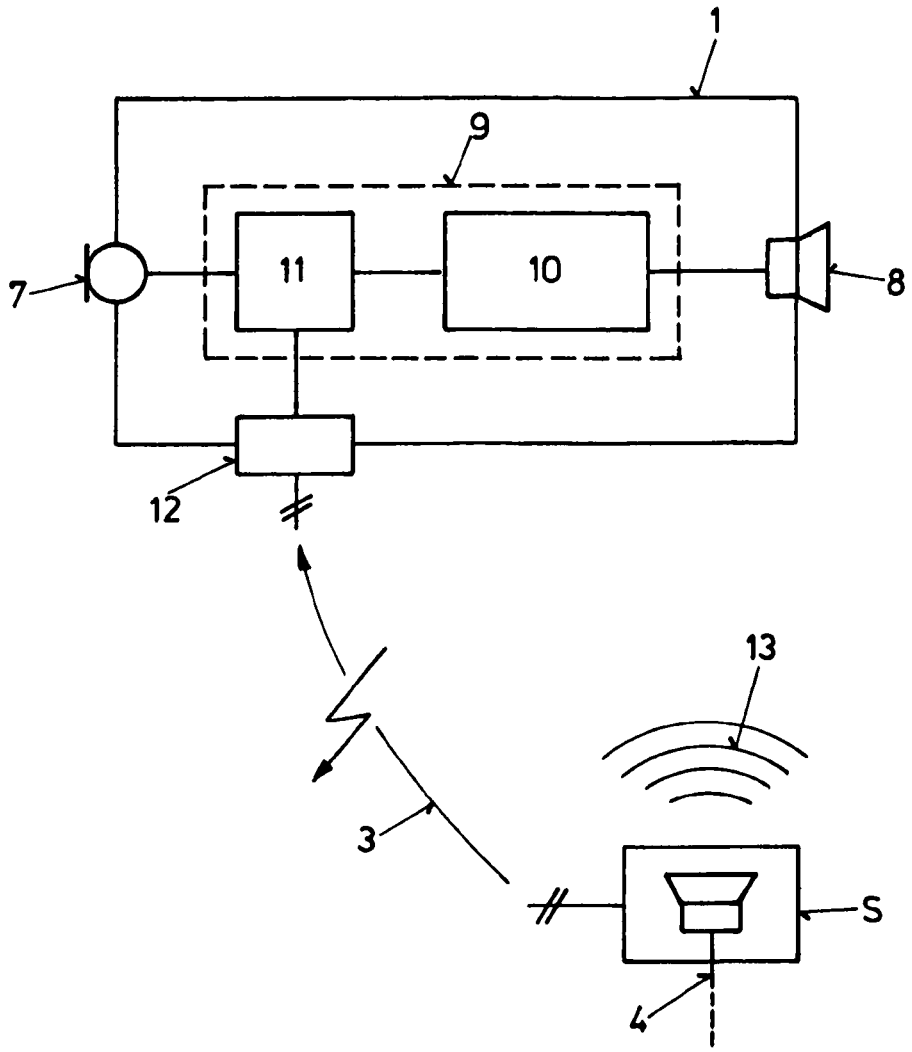
FIG. 5 shows a block diagram of a hearing device as well as a sound source.

FIG. 5 shows a block diagram of the hearing device 1 and the sound source S to further explain the present invention, in particular the embodiments depicted in FIGS. 1 to 4.

The hearing device 1 comprises an input transducer 7, e.g. a microphone, a processing unit 9, an output transducer 8, also called loudspeaker or receiver, and an interface unit 12. The input transducer 7, the output transducer 8 as well as the interface unit 12 are connected to the processing unit 9 that comprises a pre-processing unit 11 and a post-processing unit 10. The interface unit 12 is able to search for and receive a transmission signal 3 transmitted by the sound source S. The transmission signal 3 comprises an audio signal 4 that is also broadcasted by a loudspeaker as an acoustic audio signal 13 if the sound source S is not a virtual sound source S as explained in connection with FIG. 3. The audio signal 4 comprised in the transmission signal 3 is fed to the processing unit 9 in which the audio signal 4 is processed in the sense explained above, e.g. amplified/attenuated as a function of at least one of the distance d, the angle $\alpha$ and the radiation angle $\beta$. Thereby, the distance d and/or the angle $\alpha$ and/or the radiation angle $\beta$ may be determined in the hearing device 1, i.e. in the processing unit 9, or outside the hearing device 1, e.g. in an accessory device (not shown in FIG. 5).

The transmission signal 3 may be distributed by wire or wirelessly between the sound source S and the interface unit 12. In particular, the transmission signal 3 is distributed in one or more than one of the following manners:

cable, e.g. Ethernet cable, standard audio cable or USB cable;

infrared;

Bluetooth standard;

Wireless Local Area Network (WLAN);

Global System Mobile (GSM), or any other standard, e.g. UMTS.

It is to be understood that the above-described embodiments are merely illustrations of the present invention and that many variations of the above-described embodiments can be devised by those skilled in the art without departing from the scope of the invention. It is therefore indented that such variations be included within the scope of the following claims and their equivalents.

What is claimed is:

1. A method for operating a hearing device that is worn by a hearing device user, the method comprising:

receiving a transmission signal, other than an acoustic signal, that includes an audio signal of a sound source;

determining a linear distance between the sound source and the hearing device; and generating an output signal supplied to an output transducer of the hearing device, the output signal comprising at least in part the audio signal of the transmission signal if the linear distance is below a predetermined distance, the predetermined distance being determined in dependence of the sound source.

2. The method of claim 1, further comprising:

determining a user angle defined by a sagittal plane of the hearing device user and a line drawn between the hearing device and the sound source; and generating the output signal supplied to the output transducer of the hearing device by further taking into account the user angle.

3. The method of claim 1, wherein the sound source is a virtual sound source, of which a transmission signal including the audio signal is available only.

4. The method of claim 2, wherein the step of generating the output signal supplied to the output transducer of the hearing device further takes into account a radiation angle that is defined by an angle between a radiation direction of sound of the sound source and a line drawn between the hearing device and the sound source.

5. The method of claim 4, further comprising:

receiving an acoustic signal by an input transducer of the hearing device, the acoustic signal including the audio signal of the sound source; and generating the output signal supplied to the output transducer of the hearing device by combining the audio signal of the transmission signal and the acoustic signal of the input transducer according to a combination ratio that is determined as a function of at least one of the linear distance, the user angle and the radiation angle.

6. The method of claim 4, further comprising:

receiving an acoustic signal by an input transducer of the hearing device, the acoustic signal including the audio signal of the sound source; and generating the output signal supplied to the output transducer of the hearing device by reducing, according to a reduction rate, signal components of the audio signal of the sound source contained in the acoustic signal of the input transducer by using the audio signal of the transmission signal, the reduction rate being determined as a function of at least one of the linear distance, the user angle and the radiation angle.

7. The method of claim 1, wherein the transmission signal is wirelessly transmitted to the hearing device.

8. The method of claim 1, further comprising adjusting the linear distance as a function of obstacles between the hearing device and the sound source.

9. The method of claim 1, wherein the step of receiving the transmission signal including the audio signal of the sound source is performed in the hearing device.

10. The hearing device of claim 9, wherein the interface unit is a wireless interface unit that is operatively connectable to a wireless unit of the sound source.

11. A method for operating a hearing device that is worn by a hearing device user, the method comprising:

receiving a transmission signal, other than an acoustic signal, that includes an audio signal of a sound source;

determining a user angle defined by a sagittal plane of the hearing device user and a line drawn between the hearing device and the sound source; and generating an output signal supplied to an output transducer of the hearing device comprising at least in part the audio signal of the transmission signal as a function of the user angle.

12. The method of claim 11, further comprising:

determining a distance between the sound source and the hearing device; and generating the output signal supplied to the output transducer of the hearing device by further taking into account the distance.

13. The method of claim 11, wherein the step of generating the output signal supplied to the output transducer of the hearing device further takes into account a radiation angle that is defined by an angle between a radiation direction of sound of the sound source and a line drawn between the hearing device and the sound source.

14. The method of claim 11, wherein the sound source is a virtual sound source, of which a transmission signal including the audio signal is available only.

15. The method of claim 11, further comprising:

receiving an acoustic signal by an input transducer of the hearing device, the acoustic signal including the audio signal of the sound source; and generating the output signal supplied to the output transducer of the hearing device by combining the audio signal of the transmission signal and the acoustic signal of the input transducer according to a combination ratio that is determined as a function of at least one of the distance, the angle and the radiation angle.

16. The method of claim 11, further comprising:

receiving an acoustic signal by an input transducer of the hearing device, the acoustic signal including the audio signal of the sound source; and generating the output signal supplied to the output transducer of the hearing device by reducing, according to a reduction rate, signal components of the audio signal of the sound source contained in the acoustic signal of the input transducer by using the audio signal of the transmission signal, the reduction rate being determined as a function of at least one of the distance, the angle and the radiation angle.

17. The method of claim 11, wherein the transmission signal is wirelessly transmitted to the hearing device.

18. The method of claim 11, further comprising adjusting the distance as a function of obstacles between the hearing device and the sound source.

19. The method of claim 11, wherein the step of receiving the transmission signal including the audio signal of the sound source is performed in the hearing device.

20. The method of claim 1, wherein the output signal is free of the audio signal of the transmission signal if the linear distance is above the predetermined distance.

21. A hearing device comprising:

an input transducer;

an output transducer;

a processing unit operatively connected to the input transducer as well as to the output transducer;

an interface unit for receiving a transmission signal, other than an acoustic signal, that includes an audio signal of a sound source, the interface unit being operatively connected to the processing unit;

a first determining unit that is configured to determine a linear distance to the sound source; and a first generating unit that is configured to generate an output signal supplied to the output transducer of the hearing device, the output signal comprising at least in part the audio signal of the transmission signal if the linear distance is below a predetermined distance, the predetermined distance being determined in dependence of the sound source.

22. The hearing device of claim 21, further comprising:

a second determining unit that is configured to determine a user angle defined by a sagittal plane of a hearing device user (2) and a line pointing to the sound source; and a second generating unit that is configured to generate the output signal supplied to the output transducer of the hearing device by further taking into account the user angle.

23. The method of claim 21, wherein the output signal is free of the audio signal of the transmission signal if the linear distance is above the predetermined distance.

24. A hearing device comprising:

an input transducer;

an output transducer;

a processing unit operatively connected to the input transducer as well as to the output transducer;

an interface unit for receiving a transmission signal, other than an acoustic signal, that includes an audio signal of a sound sources, the interface unit being operatively connected to the processing unit;

a first determining unit that is configured to determine a user angle defined by a sagittal plane of a hearing device user and a line pointing to the sound source; and a first generating unit that is configured to generate an output signal supplied to the output transducer of the hearing device, the output signal comprising at least in part the audio signal of the transmission signal as a function of the user angle.

25. The hearing device of claim 24, further comprising:

a second determining unit that is configured to determine a distance to the sound source; and a second generating unit that is configured to generate the output signal supplied to the output transducer of the hearing device by further taking into account the distance.

26. The hearing device of claim 24, wherein the interface unit is a wireless interface unit that is operatively connectable to a wireless unit of the sound source.

* * * * *